US007487886B2

(12) United States Patent
Hecht

(10) Patent No.: US 7,487,886 B2
(45) Date of Patent: Feb. 10, 2009

(54) ARTICLE SEPARATING AND DISPENSING DEVICE

(75) Inventor: Thomas R. Hecht, Winters, CA (US)

(73) Assignee: Autpmatic Bar Controls, Inc., Vacaville, CA (US)

( * ) Notice: Subject to any disclaimer, the term of this patent is extended or adjusted under 35 U.S.C. 154(b) by 0 days.

(21) Appl. No.: 11/754,023

(22) Filed: May 25, 2007

(65) Prior Publication Data

US 2007/0228067 A1 Oct. 4, 2007

Related U.S. Application Data

(63) Continuation of application No. 10/837,542, filed on Apr. 27, 2004, now Pat. No. 7,234,611.

(60) Provisional application No. 60/550,528, filed on Mar. 5, 2004.

(51) Int. Cl.
*G07F 11/24* (2006.01)

(52) U.S. Cl. ..... 221/232; 221/221; 221/222; 221/223; 221/247

(58) Field of Classification Search ..... 221/223, 221/232, 220, 229, 221, 222, 297, 247
See application file for complete search history.

(56) References Cited

U.S. PATENT DOCUMENTS 7,234,611 B2 * 6/2007 Hecht ..... 221/232

* cited by examiner

*Primary Examiner*—Gene Crawford
*Assistant Examiner*—Timothy R Waggoner
(74) *Attorney, Agent, or Firm*—Townsend and Townsend and Crew LLP

(57) ABSTRACT

The present invention relates to a more robust article dispensing apparatus that is relatively simple in construction and usage for dispensing articles in a clean and protective environment. More specifically, the apparatus accepts, separates, and dispenses articles from a nested stack of articles such as beverage cup lids one at a time. In one embodiment, a dispensing apparatus for dispensing an article from a stack of articles each having a periphery comprises an isolating device including one or more isolating members which are movable between a hold position spaced from the stack of articles, and a dispense position contacting the periphery of one or more articles in the stack and supporting the one or more articles including an adjacent article which is adjacent an endmost article while not contacting the periphery of the endmost article by the one or more isolating members, to isolate the endmost article from the other articles in the stack to permit the endmost article to be separated from the other articles and be dispensed.

13 Claims, 7 Drawing Sheets

ARTICLE SEPARATING AND DISPENSING DEVICE

CROSS REFERENCES TO RELATED APPLICATIONS

The present application claims priority to and is a continuation of U.S. patent application Ser. No. 10/837,542, Filed Apr. 27, 2004, which is a nonprovisional utility patent application based on provisional patent Application No. 60/550,528, filed Mar. 5, 2004, the teachings of which are herein incorporated by reference in their entirety for all purposes.

BACKGROUND OF THE INVENTION

This invention relates to article dispensing apparatus and, more particularly, to an apparatus for dispensing an article from a stack of articles such as lids.

In restaurants or other food or beverage venues, lids are made available for the covering of items generally served or supplied in cups or similar containers. The cleanliness cannot be guaranteed for lids that are provided atop a stack of lids, made available in a conventional way (e.g., in an open bin-type dispenser), and presented for use. In attempting to locate a suitably clean lid, the user will often separate multiple lids from the stack of lids until a suitably clean lid is found. The removed lids are then placed away from the dispenser (allowing them to become even more unsanitary), replaced within the stack (introducing further contamination), or discarded (resulting in higher refill expense).

Article dispensing apparatus are known in the art. For example, U.S. Pat. No. 6,471,092 discloses a dispenser for dispensing an endmost lid from a stack of vertically orientated nestable lids. The dispenser may include a dispensing mechanism, which in turn further includes a track member, a tube, three supports, three arms, and three pins. The track member can have a ringed configuration and form a groove on a face. Desirably, the tube is inserted in and coupled to the track member wherein the tube forms a cylindrical chamber for receiving a stack of nestable lids and forms three triangular holes and three slots. Each support may include a body formed integrally with a post for being received within the groove and a ledge and each arm may include a body formed integrally with a post for being received within the groove and further may form a slot. Each pin can have an end received within the slot of a respective arm, whereby rotating the track member may extend and retract the ledges of supports and the pins through respective slots and triangular holes in the tube. The isolating members are rather complex. The apparatus has many parts, and is operated by a motor. The size variation range of the articles being dispensed is small.

BRIEF SUMMARY OF THE INVENTION

The present invention relates to a more robust article dispensing apparatus that is relatively simple in construction and usage for dispensing articles in a clean and protective environment. More specifically, the apparatus accepts, separates, and dispenses articles from a nested stack of articles such as beverage cup lids one at a time. Advantageously, the apparatus can immediately accept and dispense articles having different sizes (e.g., different outer diameters) without the need to readjust or reset the apparatus to a new size or size range by the user. The apparatus can be manually operated without the use of electrical, pneumatic, or hydraulic power, but may employ the use of such power as well as automation and controls.

An aspect of the present invention is directed to a dispensing apparatus for dispensing an article from a stack of articles each having a periphery. The dispensing apparatus comprises an isolating device including one or more isolating members which are movable between a hold position spaced from the stack of articles, and a dispense position contacting the periphery of one or more articles in the stack and supporting the one or more articles including an adjacent article which is adjacent an endmost article while not contacting the periphery of the endmost article by the one or more isolating members, to isolate the endmost article from the other articles in the stack to permit the endmost article to be separated from the other articles and be dispensed.

In some embodiments, the isolating device comprises a plurality of pads which are disposed circumferentially around and spaced outwardly from the periphery of the one or more articles of the stack in the hold position and are movable simultaneously inwardly from the hold position to the dispense position to contact the periphery of the one or more articles in the stack. The isolating device comprises a pad coupling plate having a plurality of pad coupling grooves extending generally in a radial direction to guide movement of the plurality of pads in the radial direction between the hold position and the dispense position. The isolating device comprises a pad driving plate having a plurality of slanted grooves and being rotatable relative to the pad coupling plate, and the pads are each connected to a pad rod having a pad rod protrusion which is connected with one of the slanted grooves on the pad driving plate. The slanted grooves are disposed at an angle between the radial direction and a first circumferential direction.

In specific embodiments, a supporting device includes one or more supporting members which are movable between the hold position contacting and supporting the endmost article, and the dispense position spaced from the endmost article. The supporting device comprises a plurality of supporting pins which are disposed circumferentially around and spaced outwardly from the periphery of the endmost article in the dispense position and are movable simultaneously inwardly from the dispense position to the hold position to contact and support the endmost article. The supporting device comprises a pin coupling plate having a plurality of pin coupling grooves extending generally in a radial direction to guide movement of the plurality of supporting pins in the radial direction between the hold position and the dispense position. The supporting device comprises a pin driving plate having a plurality of slanted grooves and being rotatable relative to the pin coupling plate, and the pins each include a pin protrusion which is connected with one of the slanted grooves on the pin driving plate. The slanted grooves are disposed at an angle between the radial direction and a second circumferential direction. The second circumferential direction is opposite from the first circumferential direction. The pad coupling plate is connected with the pin coupling plate. A spring is connected between the pad coupling plate and the pin coupling plate. During movement from the hold position to the dispense position, the pads are configured to contact and support the periphery of the one or more articles including the adjacent article before the supporting pins lose contact with the endmost article. During movement from the dispense position to the hold position, the supporting pins are configured to contact and support the endmost article before the pads lose contact with the periphery of the one or more articles.

Another aspect of the invention is directed to a dispensing apparatus for dispensing an article from a stack of articles each having a periphery. The apparatus comprises an isolating device including one or more isolating members which are movable between a hold position spaced from the stack of articles, and a dispense position contacting the periphery of one or more articles in the stack and supporting the one or more articles including an adjacent article which is adjacent an endmost article while not contacting the periphery of the endmost article by the one or more isolating members. A supporting device includes one or more supporting members which are movable between the hold position contacting and supporting the endmost article, and the dispense position spaced from the endmost article.

In some embodiments, the isolating device and the supporting device are coupled to synchronize movement between the hold position in which the one or more isolating members are spaced from the stack of articles and the one or more supporting members contact and support the endmost article, and the dispense position in which the one or more isolating members contact the periphery of one or more articles in the stack and support the one or more articles including an adjacent article and the one or more supporting members are spaced from the endmost article. During movement from the hold position to the dispense position, the one or more isolating member are configured to contact and support the periphery of the one or more articles including the adjacent article before the one or more supporting members lose contact with the endmost article. During movement from the dispense position to the hold position, the one or more supporting members are configured to contact and support the endmost article before the one or more isolating members lose contact with the periphery of the one or more articles. The isolating device and the supporting device are coupled by a resilient member.

DETAILED DESCRIPTION OF THE INVENTION

Figure 1:
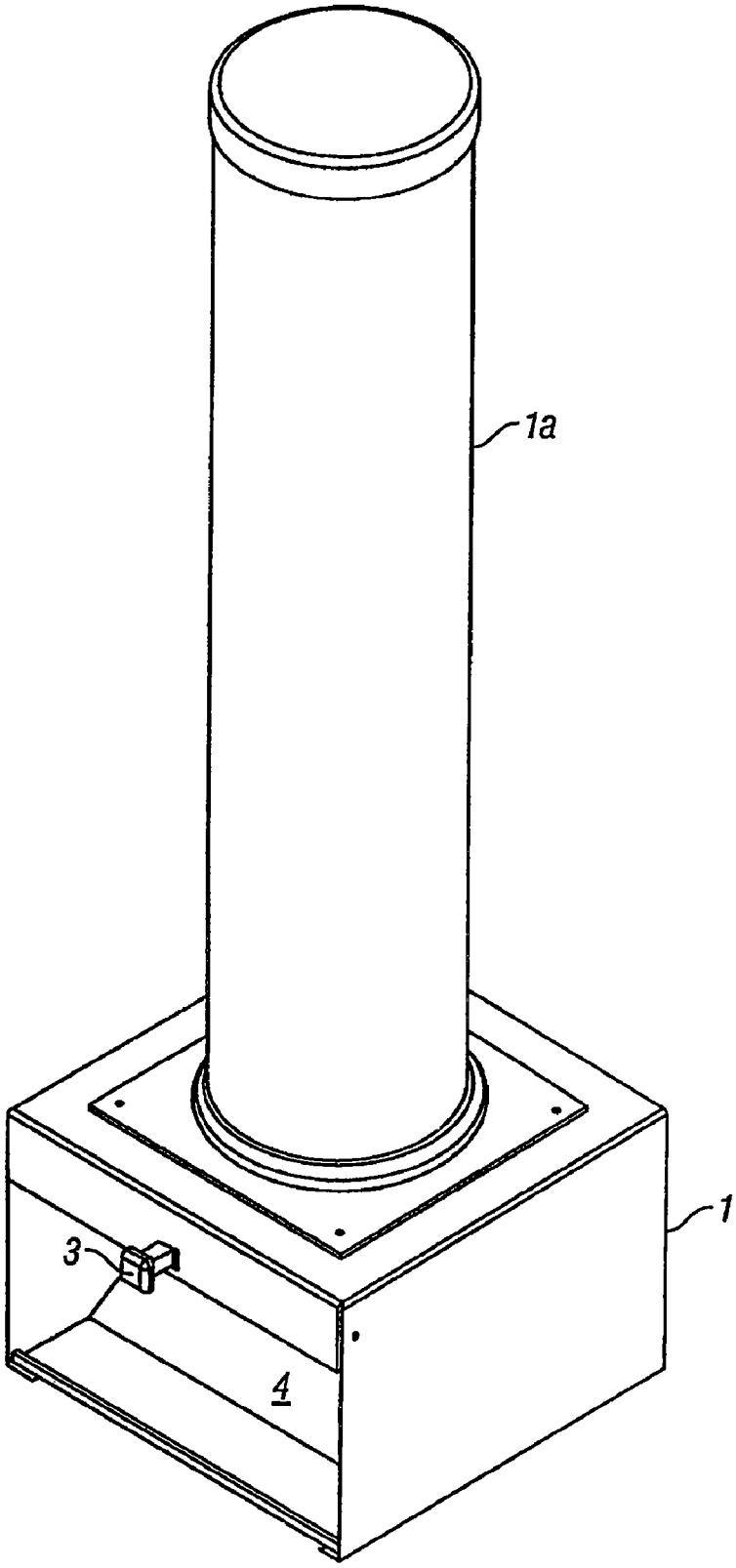
FIG. 1 is a perspective view of an article dispensing apparatus according to an embodiment of the present invention.
Figure 2:
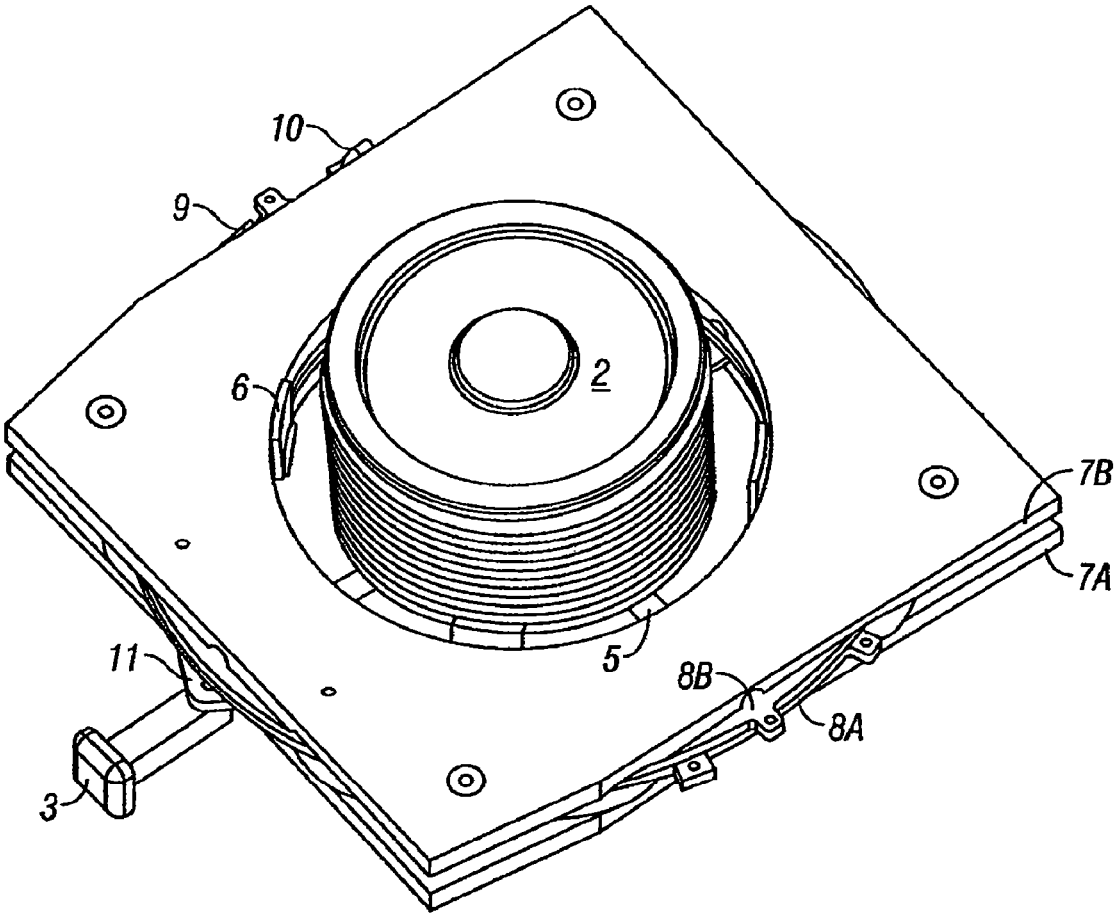
FIG. 2 is a perspective view of the dispensing mechanism of the article dispensing apparatus of FIG. 1.

FIGS. 1 and 2 show an article dispensing apparatus having a housing 1 that receives a stack of articles 2. The articles 2 in the stack have the same or substantially the same sizes. In the embodiment shown, the articles 2 have the same outer diameter and are stacked substantially vertically. The dispensing apparatus provides containment 1*a* of the articles 2 in a clean and protective environment. Actuation of a dispensing button 3, which may be manually pushed, dispenses the articles 2 one at a time from the bottom of the stack. No electrical, pneumatic, hydraulic, or other power sources are needed to release and dispense the articles, although such power sources may be employed in alternative embodiments, with- or without automation or controls. In those embodiments, the driving mechanism employing such power sources may be activated by a switch, a photo-eye, or other sensing and actuating devices. An optional ejection mechanism may be provided to push the released article at least partially out of the housing 1 for grasping by the user. The dispensed article 2 slides down an inclined surface 4 toward the user.

Figure 3:
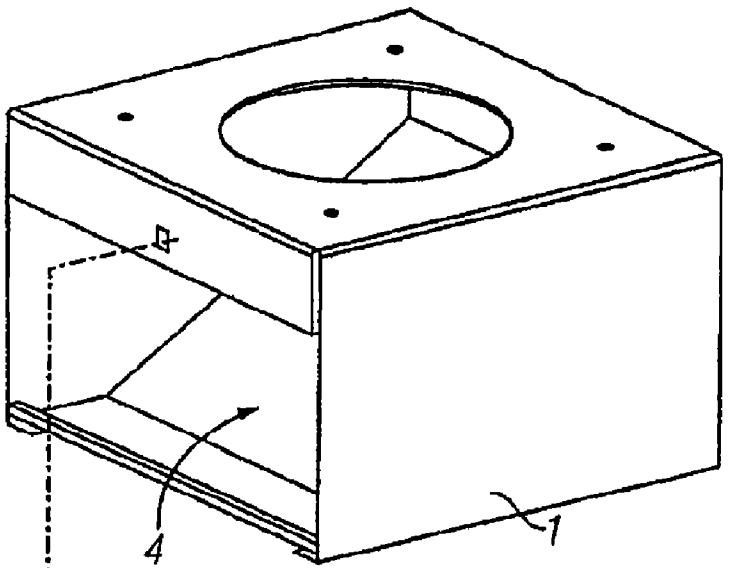
FIG. 3 is a perspective view of the housing of the article dispensing apparatus of FIG. 1.
Figure 4:
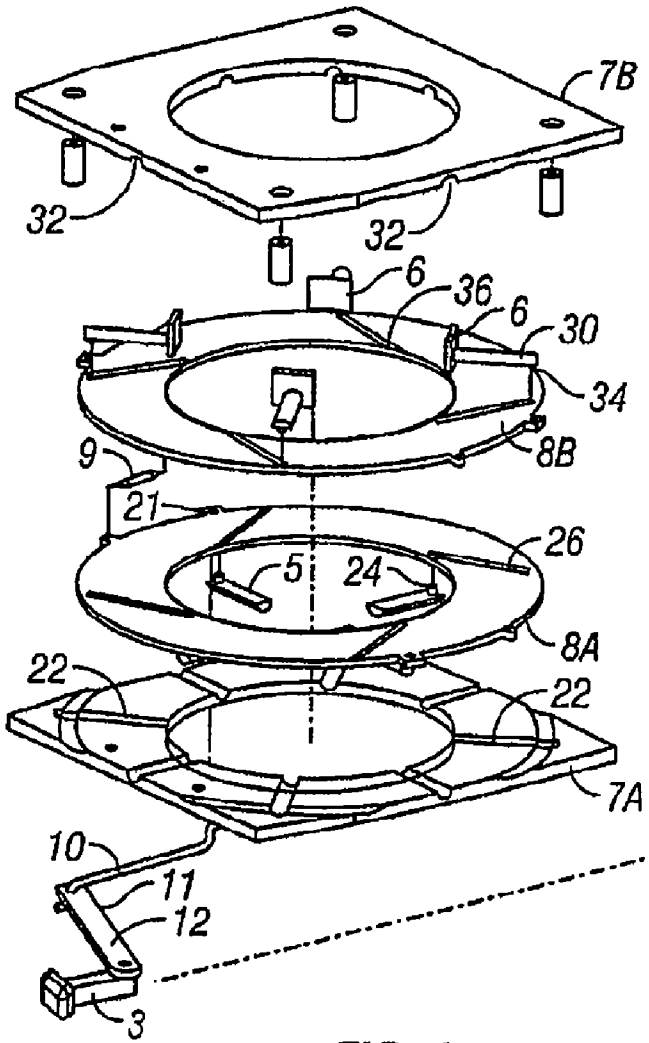
FIG. 4 is an exploded perspective view of the dispensing mechanism of FIG. 2.
Figure 6:
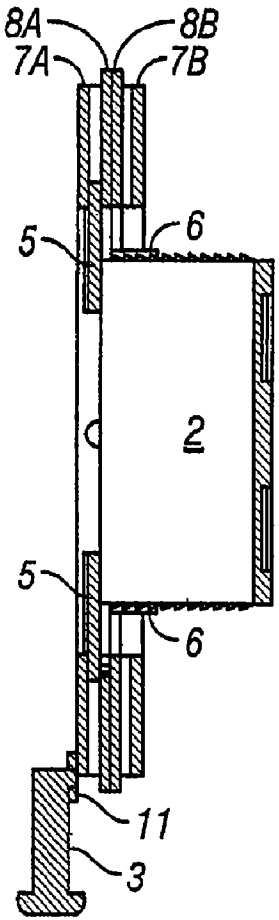
FIG. 6 is a cross-sectional view along 6-6 of the dispensing mechanism of FIG. 5.
Figure 5:
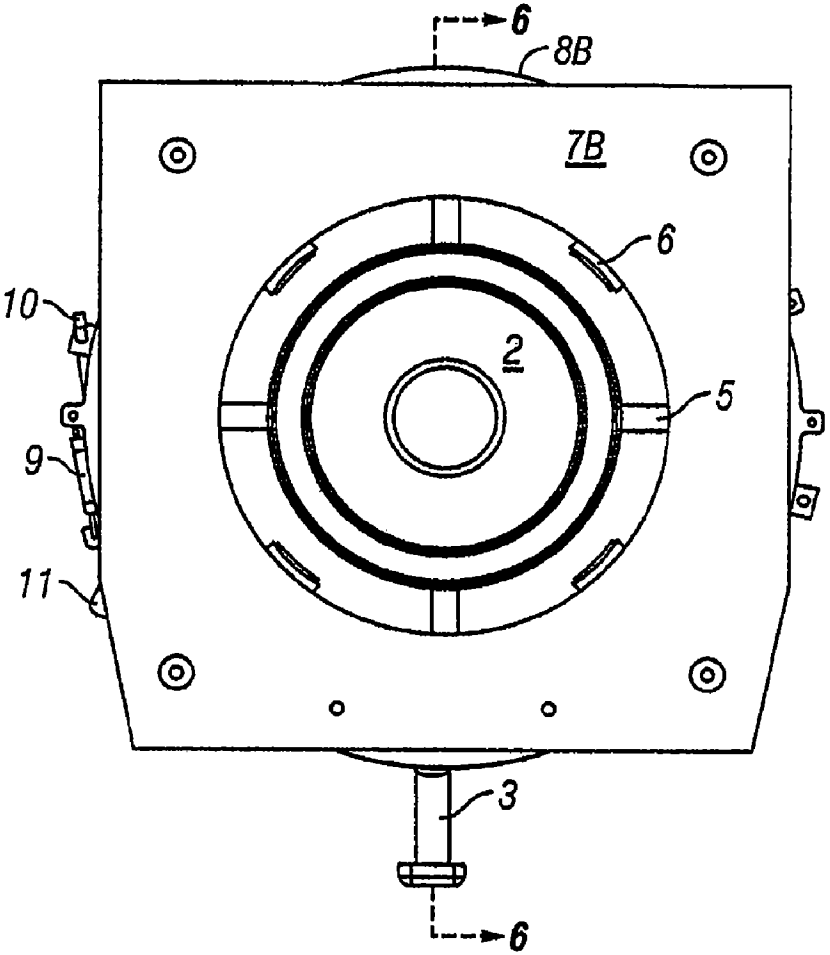
FIG. 5 is a top plan view of the dispensing mechanism of FIG. 2 in a hold position.
Figure 8:
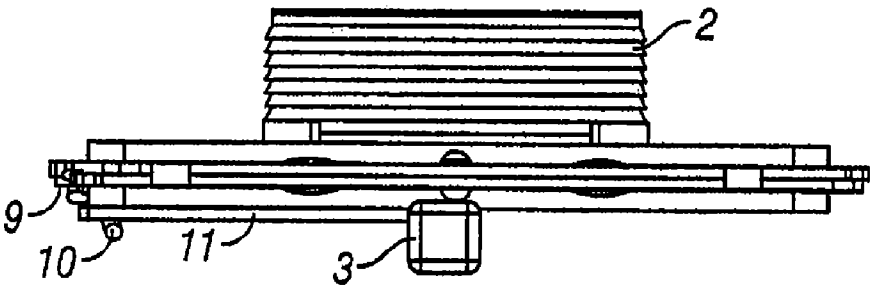
FIG. 8 is a front elevational view of the dispensing mechanism of FIG. 5.
Figure 7:
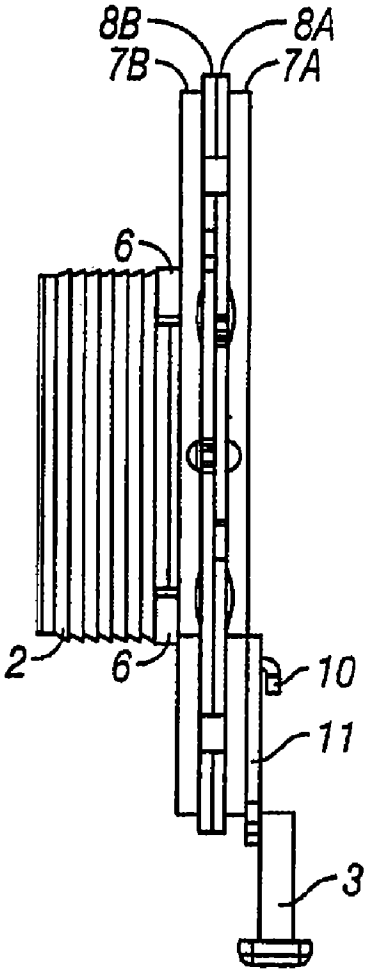
FIG. 7 is a side elevational view of the dispensing mechanism of FIG. 5.
Figure 10:
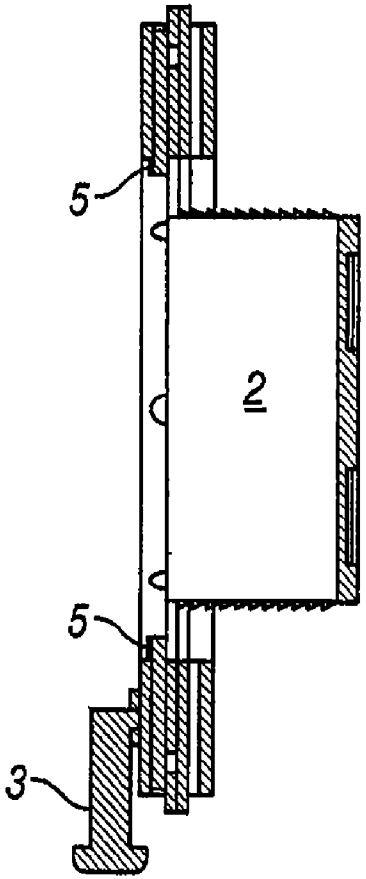
FIG. 10 is a cross-sectional view along 10-10 of the dispensing mechanism of FIG. 9.
Figure 9:
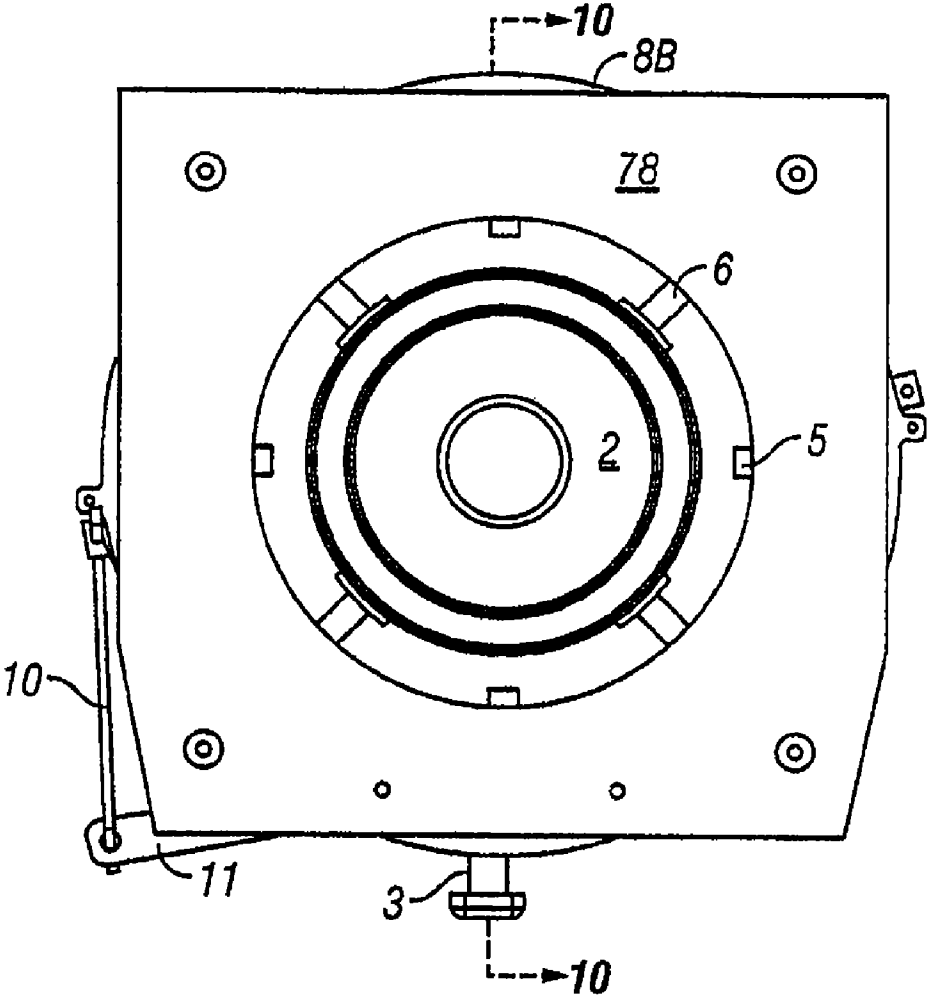
FIG. 9 is a top plan view of the dispensing mechanism of FIG. 2 in a dispense position.
Figure 12:
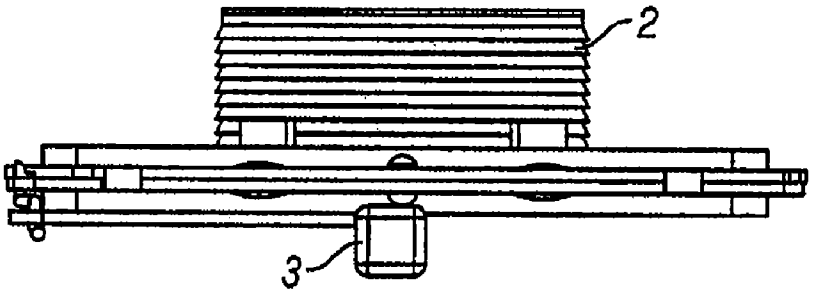
FIG. 12 is a front elevational view of the dispensing mechanism of FIG. 9.
Figure 11:
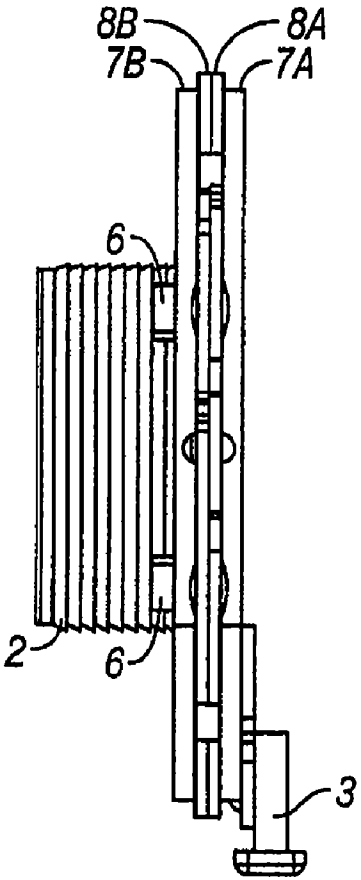
FIG. 11 is a side elevational view of the dispensing mechanism of FIG. 9.

FIGS. 2-4 show the dispensing mechanism that isolates and dispenses the articles 2 one at a time. The dispensing mechanism includes a separating or isolating device that contacts at least one article (the adjacent article) which is adjacent to the endmost article, preferably a plurality of articles including the adjacent article, and holds the article(s) in such a manner that the endmost article is not held and remains free to be separated from the other articles and be dispensed. This method is preferred over previous methods that teach contacting and holding of only the single adjacent article which is adjacent to the endmost article in order to support and retain the adjacent article and the remaining articles above the adjacent article by virtue of its own material strength. The forces encountered by the adjacent article that cause it to support the remaining articles may be so great and concentrated upon the adjacent article as to deform or cause damage to the adjacent article. The adjacent article may be unusable if it is inadvertently cracked, pierced, or distorted to such a condition that it can no longer be reliably dispensed.

As seen in FIGS. 2-4, the stack of articles 2 are supported at the bottom by a supporting device having a plurality of supporting pins 5 distributed circumferentially around the stack. The supporting pins 5 are coupled with a pin driving plate 8A. A pad driving plate 8B is disposed above the pin driving plate 8A, and is coupled with a plurality of holding pads 6 distributed circumferentially around the stack of articles 2. A pin coupling plate 7A is disposed below the pin driving plate 8A, while a pad coupling plate 7B is disposed above the pad driving plate 8B. The pin driving plate 8A is coupled to the pad driving plate 8B by a spring 9 or another resilient member. A pivoting linkage formed by rotatable linkage arms 10, 11 is connected between the dispensing button 3 and the pin driving plate 8A. The arm 11 is anchored at a pivot point 12. The linkage arm 10 is connected to a tab 21 of the pin driving plate 8A. In other embodiments, the dispensing button 3 may be connected more directly to the pin driving plate 8A.

In the embodiment shown, the pin coupling plate 7A and the pad coupling plate 7B are substantially identical but are disposed opposite one another. The pin coupling plate 7A includes radial pin coupling grooves 22 on which the supporting pins 5 slide. Each supporting pin 5 includes a pin protrusion 24 which is slidable in a corresponding slanted groove or slot 26 on the pin driving plate 8A. The slanted grooves 26 are neither radial nor tangential with respect to the pin driving plate 8A, but are disposed at an angle between the radial and tangential directions. Viewed from the top, the slanted grooves 26 are slanted in a clockwise direction outward by substantially the same angle. When the dispensing button 3 is pushed to pull the linkage arm 10, the pin driving plate 8A rotates in the counterclockwise direction with respect to the stationary pin coupling plate.7A. The pin protrusions 24 slide outward along the slanted grooves 26 to pull the pins 5 outward along the pin coupling grooves 22.

The pads 6 are each connected to a pad rod 30. The pad coupling plate 7B includes radial pad coupling grooves 32 on which the pad rods 30 slide. Each pad rod 30 includes a pad rod protrusion 34 which is slidable in a corresponding slanted groove or slot 36 on the pad driving plate 8B. The slanted grooves 36 are neither radial nor tangential with respect to the pad driving plate 8B, but are disposed at an angle between the radial and tangential directions. Viewed from the top, the slanted grooves 36 are slanted in a counterclockwise direction outward by substantially the same angle, which is opposite from the clockwise direction of the slanted grooves 26 on the pin drive plate 8A. FIGS. 5-8 illustrate the dispensing mechanism in the hold position where the supporting pins 5 are disposed inwardly to support the endmost article and the pads 6 are spaced from the stack of articles 2.

When the dispensing button 3 is pushed to pull the linkage arm 10, the pin driving plate 8A rotates in the counterclockwise direction with respect to the stationary pin coupling plate 7A. The pad driving plate 8B also rotates in the counterclockwise direction with the pin drive plate 8A. The pad rod protrusions 34 slide inward along the slanted grooves 36 to push the pads 6 inward along the pad coupling grooves 32. The pad driving plate 8B stops rotating when the pads 6 bear against the outer periphery of the article(s) 2 except for the endmost article. The use of the pads 6 allows the isolating device of the dispensing mechanism to separate or isolate articles of different sizes without any readjustment, recalibration, or modification. Preferably, the supporting pins 5 are not sufficiently withdrawn to release the endmost article at that time. The pin driving plate 8A continues to rotate in the counterclockwise direction as the spring 9 resiliently deforms or stretches between the pin driving plate 8A and the pad driving plate 8B, until the supporting pins 5 are sufficiently withdrawn to release the endmost article from the stack which falls by gravity to the dispensing area. FIGS. 9-12 illustrate the dispensing mechanism in the dispense position.

When the force pushing the dispensing button 3 is removed, the pin driving plate 8A rotates in the clockwise direction to push the supporting pins 5 inward to support the new endmost article which was the adjacent article prior to dispensing the previous endmost article. After the spring 9 resiliently returns to the undeformed position, the pad driving plate 8B rotates with the pin driving plate 8A in the clockwise direction to pull the pads 6 outward to release the grasp on the article(s) 2. Eventually, the dispensing mechanism returns to the hold position as seen in FIGS. 5-8. The configurations of the pin driving plate 8A and the pad driving plate 8B, as well as the connection therebetween by the spring 9, synchronize the movement of the supporting pins 5 and the holding pads 6.

Advantageously, the apparatus can immediately accept and dispense articles having different sizes (e.g., different outer diameters) without the need to readjust or reset the apparatus to a new size or size range by the user. The apparatus can dispense not only articles having different sizes (e.g., small, medium, large) in which the diametric variation within a given size is relatively small (e.g., about 0.25 inch), but also articles having multiple sizes by providing a capacity of relatively large diametric variations (e.g., in excess of about 2 inches). There are significant economic benefits and operational ease in using a dispensing apparatus that is capable of immediately accepting and dispensing a change in article size over a relatively large range, as opposed to prior apparatuses that can only accommodate articles having small size variations so that separate dispensing devices are needed to dispense articles having different sizes. The apparatus does not require electrical, pneumatic, or hydraulic power. In some embodiments, the apparatus can be configured to be augmented and driven or actuated by electrical, hydraulic or pneumatic motors, solenoids, pistons, or the like, with or without the use of switches, sensors, electronics, or the like. The design and dimensional relationships among the components of the apparatus can be modified to accept, separate, and dispense articles other than lids, including articles that are not circular.

It is to be understood that the above description is intended to be illustrative and not restrictive. Many embodiments will be apparent to those of skill in the art upon reviewing the above description. The scope of the invention should, therefore, be determined not with reference to the above description, but instead should be determined with reference to the appended claims along with their full scope of equivalents.

What is claimed is:

1. A dispensing apparatus for dispensing an article from a stack of articles each having a periphery, the apparatus comprising:

an isolating device including one or more isolating members which are movable between a hold position spaced from the stack of articles, and a dispense position contacting the periphery of one or more articles in the stack and supporting the one or more articles including an adjacent article which is adjacent an endmost article while not contacting the periphery of the endmost article by the one or more isolating members; and a supporting device including one or more supporting members which are movable between the hold position contacting and supporting the endmost article, and the dispense position spaced from the endmost article;

wherein the one or more isolating members in the dispense position contact the periphery of one article if the stack includes only one article which is the adjacent article in addition to the endmost article; and wherein the one or more isolating members in the dispense position contact the peripheries of at least two articles if the stack includes a plurality of articles including the adjacent article in addition to the endmost article;

wherein the one or more isolating members comprises one or more holding pads, and wherein the one or more supporting members comprises one or more supporting pins.

2. The apparatus of claim 1 wherein the isolating device and the supporting device are coupled to synchronize movement between the hold position in which the one or more isolating members are spaced from the stack of articles and the one or more supporting members contact and support the endmost article, and the dispense position in which the one or more isolating members contact the periphery of one or more articles in the stack and support the one or more articles including an adjacent article and the one or more supporting members are spaced from the endmost article.

3. The apparatus of claim 2 wherein, during movement from the hold position to the dispense position, the one or more isolating member are configured to contact and support the periphery of the one or more articles including the adjacent article before the one or more supporting members lose contact with the endmost article.

4. The apparatus of claim 2 wherein, during movement from the dispense position to the hold position, the one or more supporting members are configured to contact and support the endmost article before the one or more isolating members lose contact with the periphery of the one or more articles.

5. The apparatus of claim 2 wherein the isolating device and the supporting device are coupled by a resilient member.

6. The apparatus of claim 1 wherein the one or more isolating members in the dispense position contact the periphery of at least one article which is adjacent to the endmost article in the stack except the endmost article and support said at least one article including the adjacent article except the endmost article.

7. The apparatus of claim 1 wherein the adjacent article and the endmost article are different sizes.

8. The apparatus of claim 7 wherein the articles are beverage lids.

9. The apparatus of claim 8 wherein the size difference between the adjacent beverage lid and the endmost beverage lid is over 2 inches.

10. The apparatus of claim 1 wherein the isolating device is located above the dispensing device.

11. The apparatus of claim 1 additionally comprising an actuation mechanism for causing movement from the hold position to the dispense position.

12. The apparatus of claim 11 wherein the actuation mechanism includes a linkage and a manual dispensing button.

13. The apparatus of claim 1 wherein the isolating device and the dispensing device rotate in the same direction when moving from the hold position to the dispense position.

* * * * *